US010455876B2

(12) United States Patent
Goussev et al.

(10) Patent No.: US 10,455,876 B2
(45) Date of Patent: Oct. 29, 2019

(54) SOUND INSULATION STRUCTURE FOR A GARMENT

(71) Applicant: adidas AG, Herzogenaurach (DE)

(72) Inventors: Stanislav Goussev, Nürnberg (DE); Carl Arnese, Portland, OR (US); Justin Thomas Steeds, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 257 days.

(21) Appl. No.: 15/236,146

(22) Filed: Aug. 12, 2016

(65) Prior Publication Data

US 2017/0042265 A1 Feb. 16, 2017

(30) Foreign Application Priority Data

Aug. 13, 2015 (DE) ..... 10 2015 215 450

(51) Int. Cl.

| | |
|---|---|
| ***A41D 31/00*** | (2019.01) |
| ***A41D 13/00*** | (2006.01) |
| ***A41D 3/00*** | (2006.01) |
| ***A41D 20/00*** | (2006.01) |
| ***A42B 1/04*** | (2006.01) |
| ***G10K 11/168*** | (2006.01) |
| ***A41D 31/02*** | (2019.01) |

(52) U.S. Cl.

CPC ..... *A41D 31/0016* (2013.01); *A41D 3/00* (2013.01); *A41D 13/0002* (2013.01); *A41D 20/00* (2013.01); *A41D 31/02* (2013.01); *A42B 1/041* (2013.01); *G10K 11/168* (2013.01); *A41D 2200/20* (2013.01); *A41D 2600/10* (2013.01)

(58) Field of Classification Search

CPC ..... A41D 20/00; A41D 2200/20; A41D 31/0016; A41D 3/00; A41D 31/0011; G10K 11/168

USPC ..... 2/84

See application file for complete search history.

(56) References Cited

U.S. PATENT DOCUMENTS

| | | | | | |
|---|---|---|---|---|---|
| 2,138,822 | A * | 12/1938 | Smith | A41D 3/00 | 2/84 |
| 3,728,741 | A * | 4/1973 | Lepor | A42B 1/068 | 2/209 |
| 4,842,913 | A * | 6/1989 | Foller | A41D 31/0016 | 428/71 |
| 2003/0172432 | A1* | 9/2003 | Ishioka | A41D 1/005 | 2/84 |
| 2004/0168246 | A1* | 9/2004 | Phillips | A42B 3/064 | 2/411 |
| 2005/0167189 | A1* | 8/2005 | Aisenbrey | B29C 45/0013 | 181/199 |
| 2008/0196140 | A1* | 8/2008 | Mayerson | A41D 1/04 | 2/84 |

(Continued)

FOREIGN PATENT DOCUMENTS

| | | | |
|---|---|---|---|
| CN | 203194611 | U | 9/2013 |
| DE | 36 17 088 | A1 | 11/1987 |

(Continued)

*Primary Examiner* — Gloria M Hale

(74) *Attorney, Agent, or Firm* — Sterne, Kessler, Goldstein & Fox P.L.L.C.

(57) ABSTRACT

A sound insulation structure for a garment is disclosed. The sound insulation structure includes a first layer comprising a sound absorbing material, and a second layer configured to be at least one of sound reflecting and sound diffusing.

26 Claims, 5 Drawing Sheets

(56) References Cited

U.S. PATENT DOCUMENTS

| | | | | |
|---|---|---|---|---|
| 2009/0065299 | A1 | 3/2009 | Vito et al. | |
| 2010/0300798 | A1* | 12/2010 | Sereboff | G10K 11/165 181/175 |
| 2014/0050886 | A1* | 2/2014 | Burgin | B29D 99/0021 428/138 |
| 2015/0216250 | A1* | 8/2015 | Takeuchi | A62B 17/04 128/866 |
| 2016/0021947 | A1* | 1/2016 | Dor-El | A42B 1/08 2/461 |
| 2016/0198781 | A1* | 7/2016 | Israel | A41D 31/0011 2/84 |
| 2017/0042265 | A1* | 2/2017 | Goussev | A41D 31/0016 |

FOREIGN PATENT DOCUMENTS

| | | | |
|---|---|---|---|
| DE | 202 07 553 | U1 | 7/2003 |
| EP | 0765612 | A1 | 4/1997 |
| GB | 989970 | | 4/1965 |
| GB | 1034581 | | 6/1966 |
| GB | 1069146 | | 5/1967 |
| JP | S50-56771 | U1 | 5/1975 |
| JP | S59-76337 | U1 | 5/1984 |
| JP | S62-106927 | U1 | 7/1987 |
| WO | WO 99/34972 | A1 | 7/1999 |
| WO | WO 2014/151223 | A1 | 9/2014 |

* cited by examiner

SOUND INSULATION STRUCTURE FOR A GARMENT

BACKGROUND OF THE INVENTION

Field of the Invention

The present invention relates to a sound insulation structure for a garment, a garment comprising a sound insulation structure and a method of manufacturing a sound insulation structure.

Background Art

Noise is generally perceived as a discomfort in everyday life, in particular in urban areas. Besides direct damages, especially to the eardrums and to the auditory nerve, noise may also cause mental stress, in particular if suffered for a longer duration. Furthermore, noise may be distracting and prevent people from relaxing or concentrating on intellectual tasks. This is especially a problem for people doing fitness sports as a means for compensating for professional stress. For example, joggers often seek to enjoy tranquility or listen to music via earphones, both of which may be hindered by an excessive urban noise level. Another example is an athlete in a noisy sports hall who wants to prepare mentally for a trial, a match, or a competition.

As a counter measure, noise-cancelling headphones are known in the art. Such headphones record the ambient noise with a microphone and emit a phase-inverted sound signal such that the original ambient sound and the phase-inverted sound signal annihilate at the wearer's ear.

However, noise-cancelling headphones are complex and expensive due to additional costs in the manufacturing of the noise-cancelling technology. Furthermore, noise-cancelling headphones need a battery which must be replaced or recharged. Finally, noise-cancelling headphones, which are often bulky and rather heavy, may not be suitable for sports activities.

CN203194611U describes a sound insulation garment capable of reducing damage of noise on the human body. The sound insulation garment comprises a garment body provided with a sound insulation component therein, and the sound insulation component is a sound insulation lining which is fixedly or removably connected with the garment body. When the garment body includes a cap, the sound insulation lining is arranged in both the garment body and the cap body.

However, such a sound insulation garment has limitations and may not be able to reduce the noise to an acceptable level. This is especially true for garments having a hood or cap. A hood or cap may act like a funnel which focuses ambient noise entering from the front onto a wearer's ear due to the almost semi-spherical shape of the hood. At the same time, noise may penetrate the hood or cap and from there may reach the wearer's ear without attenuation. The situation may even be worse because the cavity formed between the wearer's head and the surrounding hood or cap may act like a resonator and may amplify certain frequencies causing an opposite and adverse effect.

BRIEF SUMMARY OF THE INVENTION

Although the human ear is sensible to sounds in the frequency range of 20 Hz to 20,000 Hz, it is particularly sensible in the frequency range of 2,000 Hz to 5,000 Hz.

Therefore, it is an object of the present invention to overcome the technical problems mentioned above and to provide a sound insulation structure for a garment which is easy to manufacture and provides for reduction of the ambient noise, especially when used with a hood or cap.

This problem is solved by a sound insulation structure for a garment, the sound insulation structure comprising at least a first layer comprising a sound absorbing material, and at least a second layer configured to be either sound reflecting, sound diffusing, or both.

The second layer may be made sound reflecting, sound diffusing, or both, due to one or more of the following characteristics: its material, the material's characteristics, its surface texturing, its shape, etc.

The invention also aims at a sound insulation structure for a garment, the sound insulation structure comprising at least a first material being sound absorbing, and at least a second material that is either at least a sound reflecting material or at least a sound diffusing material.

The invention aims at a sound insulation structure for a garment, the sound insulation structure comprising at least a first material being sound absorbing, and at least a second material being either sound reflecting, sound diffusing, or both.

The invention more particularly aims at a sound insulation structure for a garment, the sound insulation structure comprising at least a first portion comprising a sound absorbing material, and at least a second portion comprising a material being either sound reflecting, sound diffusing, or both.

The invention aims at a sound insulation structure for a garment, the sound insulation structure comprising at least a first layer comprising a sound absorbing material, and at least a second layer comprising a material being either sound reflecting, sound diffusing, or both.

A material is said to be sound reflecting when, given an impacting sound wave of a given magnitude at a given frequency on the material, at least part of the sound wave is reflected by the material.

A material is said to be sound diffusing when, given an impacting sound wave of a given magnitude at a given frequency on the material, at least part of the sound wave is reflected by the material in more than one direction so that the sum of the magnitude of the sound waves reflected by the material is strictly higher than the magnitude of each sound wave reflected by the material.

A material is said to be sound absorbing when, given an impacting sound wave of a given magnitude at a given frequency on the material, the sum of the magnitude of the sound wave reflected by the material and of the magnitude of the sound wave passing through the material is lower than the magnitude of the impacting wave.

The sound insulation structure according to the invention provides for excellent noise reduction. This is achieved by combining a sound absorbing layer with a layer which is either sound diffusing, sound reflecting, or both. The sound insulation structure according to the invention may be integrated in a garment either as separate components or in one piece. The sound insulation structure may be added to a garment, for example at the end of or after the manufacturing of the garment, or the sound insulation structure may be integral with the garment and form at least part of the garment.

The first layer comprising the sound absorbing material absorbs sound or noise that reaches the first layer. This effect may be achieved by a material which transforms sound energy (i.e., a time varying pressure field) into heat, for example, by a friction process in the first layer.

The second layer comprising the sound reflecting and/or diffusing material in combination with the first layer further reduces sound or noise reaching the ears of a wearer. A sound reflecting material reflects the impacting sound waves when they impact the surface of the sound reflecting material. A sound diffusing material diffuses the impacting sound waves in multiple directions with reduced amplitude when they impact its surface.

The first layer comprises a sound absorbing material, i.e., the material of the first layer is more sound absorbing than the material of the second layer. If the second layer comprises a sound reflecting material, then this material is more sound reflecting than the material of the first layer. If the second layer comprises a sound diffusing material, then this material is more sound diffusing than the material of the first layer. If the second layer comprises a sound reflecting and sound diffusing material, then this material is more sound reflecting and sound diffusing than the material of the first layer. In the latter case, the material of the second layer ensures both functions, i.e., it is sound reflecting and sound diffusing at the same time.

The sound insulation structure according to the invention may be used for a variety of garments including hats, caps, beanies, headbands, and garments with hoods, wherein the sound insulation structure may either (1) be arranged at least in part on the garment, (2) be embedded in the garment, or (3) form at least a layer of the garment. For example, the sound insulation structure may be embedded in or form at least a layer of a hood of a garment.

The sound insulation structure may also be arranged around a pocket of a garment for reducing the noise generated by coins, keys, etc. when the wearer of the garment walks, exercises, or runs, for example. In this case, the second layer may comprise a sound reflecting material and may be arranged toward the inside of the pocket.

The second layer may comprise a material which is either sound reflecting or sound diffusing, or both, i.e., sound reflecting and sound diffusing. Such properties may be achieved, for example, by the characteristics of the material itself or by the shape it was given, i.e., its surface structure. Also, a sound diffusing layer may be created in the sound absorbing material by giving it a specific surface shape.

The material of the first layer and the material of the second layer may be the same material, with the material having different properties in different regions. For example, the material may have a different density, fiber structure, shape, surface texture, etc. in the first layer than in the second layer. In particular, the material may have a varying density and/or fiber structure and/or shape and/or surface texture, etc., along its thickness, thus forming different layers with different properties. As a result, in the first layer, the material may be more sound absorbing than in the second layer. On the other hand, the material in the second layer may be more sound diffusing and/or reflecting than in the first layer.

Also, the sound insulation structure may present different layers with different properties, be it made by varying the number of layers, and/or by varying the properties of the layers (e.g., thickness, material, material's characteristics, etc.). In particular, a sound insulation structure according to the invention may comprise more than one sound absorbing layer in at least a portion. These two or more sound absorbing layers may overlap. Alternatively or additionally, the thickness of a sound absorbing layer may vary along at least one of its other two dimensions.

In a sound insulation structure according to the invention, the first layer and the second layer may at least partially overlap. For example, if the sound insulation structure is part of a hood, both layers may overlap in the region of the ears to provide for a good attenuation of ambient noise.

In some embodiments, the first layer may be separated from the second layer, i.e., first and second layers may be arranged at different locations on the garment. In other embodiments, the first layer may at least partially overlap the second layer. In still other particular embodiments, the first layer and the second layer may entirely coincide. Thus, different arrangements of the first and second layers are possible which may be chosen depending on the type of application.

The material of the first layer may be any sound absorbing material with a high absorbing ratio, such as a foam, a material comprising some partially-void cavities, or a spacer knit fabric. In the latter case, the spacer knit fabric may be chosen to have good sound absorbing properties which may be achieved for example by appropriate yarns, in particular an appropriate material and diameter of one or more spacer yarn(s), and/or by an appropriate knitting technique, and/or by appropriate distance between the two knit fabric surfaces connected by the spacer yarn(s).

The second layer may be arranged on an outer side of the first layer. The second layer can be directly along the outer surface of the first layer, or on the outer surface of the first layer but separated from the first layer by one or more other layers. In particular, in some embodiments, the second layer may be arranged on an outer surface of the garment. For example, the second layer may be of sound reflecting material arranged at least partially above a first layer of sound absorbing material. In this way, the sound reflecting layer first reflects as much sound waves away as possible. Then, the sound absorbing layer absorbs as much of the remaining sound waves as possible. The combination of the two layers provides for excellent sound insulation properties.

The second layer may be configured to be sound reflecting and the sound insulation structure may further comprise a third layer configured to be sound diffusing. In particular, the second layer may comprise a sound reflecting material and the sound insulation structure may further comprise a third layer comprising a sound diffusing material. The material of the third layer is understood to be more sound diffusing than the material of the first layer and the material of the second layer. However, the same material could be used for the third layer and the first layer and/or the second layer with different properties in each layer. For example, the material may have a different density, fiber structure, shape, surface texture, etc. in the first layer than in the third layer. Thus, in the first layer, the material may be more sound absorbing than in the third layer. On the other hand, the material in the third layer may be more sound diffusing than in the first layer. The third layer may for example be a warp knitted layer. The third layer may for example be created in the sound absorbing material by giving the first layer made of sound absorbing material a specific surface shape for diffusing sound, for example a surface having cone-like or pyramid-like shapes.

The third layer may be arranged on an inner surface of the garment. If the sound insulation structure is, for example, arranged on a hood of a garment, then the sound diffusing inner layer avoids or at least reduces the funnel effect described above by diffusing the impacting sound waves in all directions instead of focusing them onto the ears of the wearer. Likewise, resonances may be reduced by the sound diffusing inner surface of the hood. The hood may additionally comprise a sound reflecting outer layer which in combination with the sound absorbing first layer may further reduce the noise perceived under the hood.

The material of the first layer and the material of at least said second layer may be chosen so as to reduce average sound pressure by at least 3 dB at least in the frequency range of 1,000 Hz to 4,000 Hz. Furthermore, the material and the thickness of the first layer and the shape, material and the thickness of at least said second layer may be chosen so as to reduce average sound pressure by least 5 dB at least in the frequency range of 1,000 Hz to 4,000 Hz in portions where the first layer and the second layer overlap. By shape, it is understood that the general shape and/or the surface texturing of the layer may be chosen so as to achieve desired sound reduction.

The material of the first layer and the material of at least said second layer may be chosen so as to reduce average sound pressure by at least 5 dB at least in the frequency range of 4,000 Hz to 8,000 Hz. Furthermore, the material and the thickness of the first layer and the shape, the material and the thickness of at least said second layer may be chosen so as to reduce average sound pressure by least 7 dB at least in the frequency range of 4,000 Hz to 8,000 Hz in portions where the first layer and the second layer overlap. The material and thickness of the first layer and the shape, material and thickness of the second layer may be chosen so as to reduce average sound perceived by a wearer of the garment by 0.5 to 1 sone at least in the frequency range of 4,000 Hz to 8,000 Hz in portions where the first layer and the second layer overlap.

In general, in the context of the present invention, a sound insulation structure for a garment is envisaged, which reduces average sound pressure by at least 3 dB at least in the frequency range of 1,000 Hz to 4,000 Hz. The sound insulation structure may reduce average sound pressure by at least 5 dB at least in the frequency range of 1,000 Hz to 4,000 Hz.

In the context of the present invention, a sound insulation structure for a garment is envisaged, which reduces average sound pressure by at least 3 dB at least in the frequency range of 2,000 Hz to 5,000 Hz. The sound insulation structure may reduce average sound pressure by at least 5 dB at least in the frequency range of 2,000 Hz to 5,000 Hz.

The sound insulation structure may reduce average sound pressure by at least 5 dB, in particular by at least 8 dB, and in some embodiments by at least 13 dB in the frequency range of 4,000 Hz to 8,000 Hz.

The sound insulation structure may reduce the sound perceived by a wearer of the garment by at least 0.3 sones, in particular by 0.5 sones in the frequency range of 1,000 Hz to 4,000 Hz. The sound insulation structure may reduce the sound perceived by a wearer of the garment by at least 0.5 sones, in particular by at least 0.7 sones, more particularly by at least 0.9 sones in the frequency range of 4,000 Hz to 8,000 Hz.

The sound insulation structure reduces average sound pressure and/or sound perceived by a wearer of the garment at least for sound waves impacting the sound insulation structure perpendicular to a surface of the sound insulation structure.

The sound insulation structure may have a total thickness of less than 30 mm.

In general, in the context of the present invention, a sound insulation structure for a garment is envisaged having a total thickness of less than 30 mm. The total thickness may be less than 20 mm, in particular less than 10 mm, and in some embodiments less than 5 mm, e.g., about 3 mm. In particular, these thicknesses may be realized with a sound insulation structure having the damping characteristics as described above.

Furthermore, in the context of the present invention, a sound insulation structure for a garment is envisaged, which reduces average sound pressure by at least 5 dB at least in the frequency range of 1,000 Hz to 4,000 Hz, and/or by at least 5 dB at least in the frequency range of 2,000 Hz to 5,000 Hz, and/or by at least 8 dB in the frequency range of 4,000 Hz to 8,000 Hz, and which comprises a total thickness of less than 30 mm, in particular less than 20 mm, in particular less than 10 mm, and in some embodiments less than 5 mm, e.g., about 3 mm.

The sound insulation structure comprising a total thickness of less than 30 mm, in particular less than 20 mm, in particular less than 10 mm, and in some embodiments less than 5 mm, e.g., about 3 mm, may reduce average sound pressure by at least 8 dB, more particularly by at least 10 dB, and in some embodiments by at least 16 dB at least in the frequency range of 4,000 Hz to 20,000 Hz. The sound insulation structure comprising a total thickness of less than 30 mm, in particular less than 20 mm, in particular less than 10 mm, and in some embodiments less than 5 mm, e.g., about 3 mm, may reduce average sound pressure by at least 6 dB, in particular by at least 10 dB, and in some embodiments by at least 15 dB in the human ear range of 20 Hz to 20,000 Hz.

The sound insulation structure comprising a total thickness of less than 30 mm, in particular less than 20 mm, in particular less than 10 mm, and in some embodiments less than 5 mm, e.g., about 3 mm, may reduce the sound perceived by a wearer of the garment by at least one sone, more particularly by at least two sones. The sound insulation structure comprising a total thickness of less than 30 mm, in particular less than 20 mm, in particular less than 10 mm, and in some embodiments less than 5 mm, e.g., about 3 mm, may reduce average sound pressure and/or sound perceived by a wearer of the garment for sound waves impacting the sound insulation structure perpendicular to a surface of the sound insulation structure.

Nonetheless, in some particular embodiments, the sound insulation structure may have a total thickness of more than 30 mm, allowing to further improve the sound insulation. Such sound insulation structure could be placed in a hood for an outdoor jacket for example.

At least one of the layers of the sound insulation structure according to the invention may be textured. Surface texturing may be achieved by providing the surface with a 3D shape. Surface texturing may improve the sound diffusion properties of that layer. The textured layer may be covered by one or more layers. Thus, the textured layer may not be visible from the outside and/or inside. For example, the first layer may be sandwiched between two other layers. One of those layers may comprise the sound reflecting second layer. In addition, the other layer may be sound diffusing and be applied on the textured surface of the first layer in order to maximize the sound diffusion by the combination of this layer and of the first layer's texturing. The surface texturing also improves sound absorption because an impacting sound wave which is globally orthogonal to the sound insulation structure is locally scattered on a larger surface than when impacting a flat surface perpendicularly.

The surface texturing may occur on an inner surface, an outer surface, or both surfaces of said textured layer.

The surface texturing may have the shape of organized or unorganized pyramids, hemispheres, cones, cubes, ridges, etc. The shapes may or may not all have the same height and/or sizes. Surface texturing may also be provided by a second layer being a knitted layer. Thus, the knitted layer forms small holes, a relief of some depth, and/or a certain pattern which increases sound diffusion.

At least one layer may be made from a mesh. A mesh provides for good drape qualities and enhanced fit and comfort. If, for example, a mesh sound reflecting layer is arranged at the outer surface of a garment, the perforations of the mesh would provide the overall composite material with a superior fit. Also, the holes of the mesh, and the cavities it may create by sitting loose on another layer, can improve the sound diffusion of the sound insulation structure. The material of the mesh may also at least partially absorb acoustic waves.

The second layer may be a coating. For example, the sound insulation structure may comprise a first sound absorbing core layer, wherein the second layer is a coating on the core layer. The coating may be arranged on an outer and/or inner surface of the core layer. Such coating may be sound reflecting and/or sound diffusing, thereby forming a second or third layer on the core layer. Such coating may also be applied on other layers of the garment, such as for example on a fabric layer put outside or inside the sound absorbing layer for esthetic reasons or thermal insulation.

The first layer and/or the second layer or both may be removable from the sound insulation structure. Thus, the first layer and/or the second layer may be removably attached to the sound insulation structure. In one embodiment, the whole sound insulation structure may be removably attached to the garment. Means for removably attaching the layers and/or the sound insulation structure may be a hook-and-loop fastener, a zipper, a press-stud, or the like.

Alternatively, the first layer may be bonded to at least a second layer. If the sound insulation structure comprises a third layer, the third layer may be bonded to the first layer and/or the second layer. Such bonding may be obtained by gluing the second layer onto the first layer. Alternatively, the first layer may be attached to at least a second layer at spaced intervals, for example, by stitching.

The first layer may be attached to at least a second layer by stitching. The layers of the sound insulation layer may be stitched using a merrow stitch (also called overlock stitch). Such a seam creates a good bonding between the layers of such structure. A bonding tape (made from PU or TPU) could be placed over the seam to secure the stitch, to reinforce the seam, to improve water impermeability, and/or for esthetical reasons.

At least one layer may comprise perforations. In this way, breathability of the sound insulation structure and, thus, of the garment may be improved.

At least a portion of the sound insulation structure may be capable of forming, being embedded in, or being attached to a hood. Thus, the funnel effect mentioned above may be reduced.

Throughout this disclosure, the average sound reduction in a frequency range is understood as an average of the sound reduction values obtained for a plurality of frequencies in this frequency range.

The geometry of the sound insulation structure in a hood, the material and the thickness of the first layer, and the material and the thickness of at least said second layer may be chosen so as to reduce average sound pressure by least 5 dB at least in the frequency range of 1,000 Hz to 4,000 Hz, for sound waves toward the back of the hood, toward the side of the hood, and toward the front of the hood, where the opening of the hood is the front of the hood. The geometry of the sound insulation structure in the hood can include the position of the sound insulation structure in the hood, the shape and sizes of the sound insulation structure, the structure of the sound insulation structure, and the geometry of the hood itself.

More particularly, the geometry of the sound insulation structure in the hood, the material and the thickness of the first layer, and the material and the thickness of at least said second layer may be chosen so as to reduce average sound pressure by at least:

- 5 dB at least in the frequency range of 1,000 Hz to 4,000 Hz, for sound waves toward the front of the hood, in particular at least 8 dB, and more particularly 11 dB,
- 5 dB at least in the frequency range of 1,000 Hz to 4,000 Hz, for sound waves toward the side of the hood, in particular at least 9 dB, and more particularly 12 dB,
- 5 dB at least in the frequency range of 1,000 Hz to 4,000 Hz, for sound waves toward the back of the hood, in particular at least 7 dB, and more particularly 10 dB.

The geometry of the sound insulation structure in the hood, the material and the thickness of the first layer, and the material and the thickness of at least said second layer may be chosen so as to reduce average sound pressure by at least 5 dB at least in the frequency range of 4,000 Hz to 8,000 Hz, for sound waves toward the back of the hood, toward the side of the hood, and toward the front of the hood, where the opening of the hood is the front of the hood. In particular, the geometry of the sound insulation structure in the hood, the material and the thickness of the first layer, and the material and the thickness of at least said second layer may be chosen so as to reduce average sound pressure by at least 7 dB at least in the frequency range of 4,000 Hz to 8,000 Hz for sound waves toward the back of the hood, toward the side of the hood, and toward the front of the hood. More particularly, the geometry of the sound insulation structure in the hood, the material and the thickness of the first layer, and the material and the thickness of at least said second layer may be chosen so as to reduce average sound pressure by at least:

- 8 dB at least in the frequency range of 4,000 Hz to 8,000 Hz, for sound waves toward the front of the hood, in particular at least 10 dB, and more particularly 16 dB,
- 12 dB at least in the frequency range of 4,000 Hz to 8,000 Hz, for sound waves toward the side of the hood, in particular at least 16 dB, and more particularly 22 dB,
- 7 dB at least in the frequency range of 4,000 Hz to 8,000 Hz, for sound waves toward the back of the hood, in particular at least 10 dB, and more particularly 14 dB.

The hood may be configured so that the distance between the hood and an ear of a wearer is at maximum 20 cm. In some embodiments, the distance is less than 80 mm, and more particularly between 10 mm and 40 mm.

In some embodiments including, for example, hooded garments, but also hats, beanies, headbands, and caps, the garment may be fit on the ears of the wearer, thereby reducing the distance to 0 mm. The garment may be stretchable so that the garment tightly fits the wearer's head, thereby annihilating the funnel effect. In some embodiments the hood comprises an inner layer configured to fit on the head of a wearer and an outer layer sitting loosely around the inner layer—the sound insulation structure can be in one or the other of these layers or be partly in one of them and partly in the other one.

The hood may be configured so that the frontal tip of the hood comes to the forehead of a wearer. The hood may in particular be configured so that the frontal tip of the hood comes to the forehead of a wearer when the head of the wearer touches the back of the hood. In some embodiments, the hood comes down to the eyebrows. Thus, more sound is prevented from entering the hood than when the frontal tip of the hood comes down at a higher point. In some embodiments, the hood's tip may come down lower than the eyebrows (e.g., to the nose) in order to further reduce the incoming noise. At the same time as noise is reduced, incoming light and the field of vision is reduced as well, thus helping the wearer to concentrate, e.g., on a trial, match, or exercise.

The hood may be configured to enclose at least 220° of the space around a wearer's head, in particular at least 260°, and more particularly at least 275°. The covering angle of the hood may be defined from the center of the wearer's head and may be defined in a cross sectional plane perpendicular to the wearer's longitudinal axis (i.e., a transverse plane in an anatomical meaning or horizontal plane). Large covering angles of the hood help to reduce the amount of sound entering the hood when worn.

The hood may comprise means to tighten the opening of the hood. This permits to lower the sound entering from the front opening of the hood. The tightening means may be, for example, a draw cord. The cord may be arranged in a tunnel, e.g., sewn on the edge of the hood's opening. Such an arrangement has a very good effect of lowering the noise and may provide for a further average damping of 5 dB to 10 dB for sound in the frequency range of 4,000 Hz to 8,000 Hz entering from the front of the hood.

The hood may comprise a flap configured to be removably attached to a side of an opening of the hood so as to reduce the opening of the hood when closed. The flap may be formed in one side of the opening of the hood and be removably attachable to an opposite side of the hood. Alternatively, such flap may be removably attachable on both sides of the opening of the hood. Reducing the opening of the hood may reduce the sound incoming from the front of the hood. Flaps are perceived as comfortable and aesthetic. The flap may be closed by attaching it to the opposite side of the hood by means of a hook-and-loop fastener, a press-stud, a magnet, or the like. The flap may be arranged in the bottom of the hood so as to close the opening in front of the neck of a wearer. In some embodiments, the flap may be configured to close the opening in front of a chin of a wearer.

A further aspect of the present invention relates to a garment comprising a sound insulation structure as described herein and in particular as described above.

The garment may comprise a hood and the sound insulation structure may be arranged at least partially on the hood or form the hood. What has been said above with respect to a hood is valid for such an embodiment as well. The garment may be a hat, headband, or beanie as well.

The sound insulation structure may be removably attached to the garment. Means for removably attaching the sound insulation structure may for example include a hook-and-loop fastener, a press-stud, a zipper, a magnet, and the like.

A sound insulation structure according to the invention may allow some sound frequencies to pass through it with little or no attenuation. For example the sound insulation structure may be designed so as to let sounds with frequencies of car horns, or other types of signaling, pass through.

In some embodiments, the sound insulation structure may be constructed so as to fold and unfold, similarly to an origami. In particular, a hood comprising such sound insulation structure may fold and unfold in a plurality of plies.

The sound insulation structure may further comprise an electronic noise-cancelling means. The electronic noise-cancelling means may comprise sound recording means which is configured to record ambient sound, and sound emitting means which is configured to emit a phase-inverted sound signal such that the original ambient sound and the phase-inverted sound signal annihilate at an ear of the wearer of the garment. The sound recording means may comprise a microphone and the sound emitting means may comprise a loudspeaker, a headphone, or an earphone. The noise-cancelling means may be arranged between the first layer and the second layer.

A hood according to the invention may also comprise a visor at the front to create a better fit around the opening. Such visor may be bonded to at least one of the sound insulation layers.

A further aspect of the present invention relates to a sound insulation structure for a wearable accessory comprising at least a first layer comprising a sound absorbing material, and at least a second layer configured to be either sound reflecting, sound diffusing, or both. The wearable accessory may for example be a bag or backpack. What has been said above with respect to the sound insulation structure for a garment is valid for the sound insulation structure for a wearable accessory as well.

But, for example in the case of a bag or a backpack, similar to when the sound insulation structure is implemented in a pocket, the layers are arranged so as to reduce the sound going out of the bag, backpack, pocket, etc.

A still further aspect of the present invention relates to a method of manufacturing a sound insulation structure for a garment, comprising the steps of providing at least a first layer comprising a sound absorbing material, providing at least a second layer configured to be either sound reflecting, sound diffusing, or both, and at least partially joining the first layer and the second layer.

The first layer and the second layer may be joined permanently, e.g., by welding, sewing, gluing, and the like. Alternatively, the first layer and the second layer may be removably attached to each other, e.g., by means of a hook-and-loop fastener, a press stud, a zipper, and the like. The bonding technique of two layers of a sound insulation structure according to the invention permit modification of the performance of sound insulation and may permit modification of the frequencies of sound that it insulates from.

The first layer and the second layer may also be joined by dropping one layer in a mold before foam, which forms the other layer, is poured over the layer in the mold. The foam may thus adhere to the layer previously laid in the mold. In particular, a mesh may be laid in the mold, and the foam poured on the mesh.

The method may further comprise the step of arranging the first layer and the second layer such that the first layer and the second layer overlap at least partially in the garment.

The second layer may be configured to be sound reflecting, and the method may further comprise the steps of providing a third layer configured to be sound diffusing, and at least partially joining the third layer and the first layer. In particular, the second layer may comprise a sound reflecting material, and the method may further comprise the steps of providing a third layer comprising a sound diffusing material, and at least partially joining the third layer and the first layer.

The method may further comprise the step of molding the second layer, such that it is configured to diffuse sound. In particular the method may further comprise the step of molding a material so as to form the second layer and so as to be sound diffusing.

The method may further comprise the step of molding the sound absorbing material, such that it diffuses sound on at least one surface. In particular, the method may further comprise the step of molding the sound absorbing material to a shape configured to diffuse sound on at least one surface.

In the context of the present invention, a method of manufacturing a sound insulation garment is envisaged, comprising the steps of providing a garment element, and coating a sound reflecting material on the garment element. The garment may in particular comprise a hood and the sound reflecting material may be coated at least partially on the hood. The sound reflecting material may be coated on a sound absorbing layer of the garment element. The coating may be a spray coating.

The sound insulation structure manufactured by methods as described herein may be a sound insulation structure as described herein and in particular as described above. Likewise, the garment for which the sound insulation structure is suitable may be a garment as described herein and in particular as described above.

Each layer of a hood according to the invention may be made from one or a plurality of pieces joined together. In particular at least one layer of the hood may be made from at least two pieces joined together, e.g., by sewing, gluing, or welding. A bonding tape (made, e.g., from PU or TPU) could be placed over the seam between two pieces to reinforce the seam, for esthetical reasons, and/or to improve water impermeability.

Alternatively, the pseudo-semi-spherical shape of the hood can for example be achieved by appropriately molding each layer to this shape, or by using a 3D manufacturing process like 3D printing, 3D spraying a viscous material, or 3D warp or weft knitting. Such layer would thus be in one piece, with no stitching, which may also improve the sound insulation of the sound insulation structure, in particular with respect to the sound absorbing layer. Such insulation may also further be improved, together with the fit and comfort, by using a 3D scan of a customer's head and customizing the hood's shape to the head of the customer.

In a method according to the invention, dots could be applied on a surface of the sound insulation structure and/or on the surface of the garment in order to increase the sound insulation. In such a method, dots could be printed using a printing nozzle applying dots of a viscous fluid. A sound insulation structure or a garment comprising such dots may therefore have a textured surface, which may improve sound diffusion.

BRIEF DESCRIPTION OF THE DRAWINGS/FIGURES

Aspects of the present invention will be explained in more detail with reference to the accompanying figures in the following. These figures show:

DETAILED DESCRIPTION OF THE INVENTION

In the following, embodiments and variations of the present invention are described in more detail.

Figure 1:
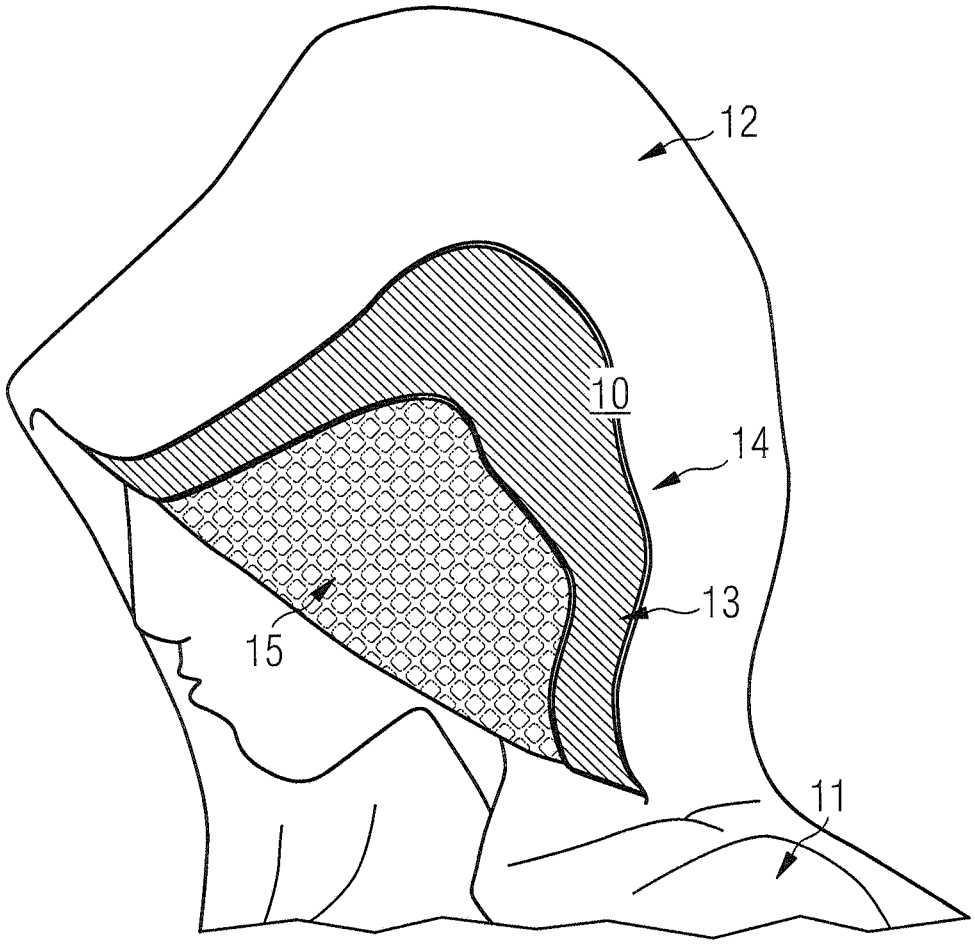
FIG. 1 shows an exemplary embodiment of a sound insulation structure according to the invention arranged on a hooded garment with cut-away portions to reveal different layers.

FIG. 1 shows an exemplary embodiment of a sound insulation structure 10 for a garment 11. The garment 11 in the exemplary embodiment of FIG. 1 is a hooded garment like a tracksuit top. In general, the sound insulation structure 10 according to the invention may be used for a variety of garments including hats, caps, and beanies. The sound insulation structure 10 may alternatively or additionally be arranged around a pocket of a garment which reduces noise generated by coins, keys, etc. when the wearer of the garment walks, exercises, or runs, for example.

In the exemplary embodiment of FIG. 1 the sound insulation structure 10 is arranged on the hood 12 of the garment 11. The sound insulation structure 10 comprises a first layer 13 comprising a sound absorbing material. In the exemplary embodiment of FIG. 1, the first layer 13 is a core layer of the hood 12. The first layer 13 comprises a sound absorbing material, i.e., the material of the first layer 13 is more sound absorbing than the material of the second layer 14 of the sound insulation structure 10 to be discussed below. The material of the first layer 13 may be a foam, a material comprising some partially-void cavities, a mesh, or a spacer knit fabric. In the latter case, the spacer knit fabric may be chosen to have good sound absorbing properties which may be achieved for example by an appropriate spacer yarn and/or by an appropriate knitting technique.

In the embodiment of FIG. 1, the material of the first layer 13 is a polyurethane foam.

The sound insulation structure 10 also comprises a second layer 14 of a sound reflecting material. The sound reflecting material of the second layer 14 is more sound reflecting than the material of the first layer 13.

The material of the second layer 14 may, for example, be a coating coated onto the first layer 13.

The second layer 14 of the sound insulation structure 10 according to the invention may be obtained by texturing the first layer's surface. Surface texturing may be achieved by providing the surface with a 3D shape. Surface texturing may improve the sound diffusion properties of the sound insulation structure. The textured second layer 14 may be covered by one or more layers. Thus, the textured second layer 14 may not be visible from the outside and/or inside. For example, the first layer 13 and second layer 14 may be sandwiched between two other layers. One of those latter layers may comprise a sound diffusing and/or reflecting layer. The surface texturing may be at an inner surface, an outer surface or both surfaces of the first layer 13. The surface texturing may have the shape of pyramids, hemispheres, cubes, etc. Surface texturing may also be provided by a knitted first layer 13. Thus, the knitted layer forms small holes, a relief of some depth and/or a certain pattern which increases sound diffusion.

In the exemplary embodiment of FIG. 1, the second layer 14 is arranged as an outer layer of the hood 12 of the garment 11 and comprises a sound reflecting material. However, in other embodiments, the second layer 14 may comprise a sound diffusing material or a material being both sound reflecting and sound diffusing. Also, in other embodiments, the second layer 14 may be arranged as an inner layer of the hood 12, i.e., beneath the first layer 13 and may be sound reflecting, sound diffusing or both. This may also be advantageous, for example, in applications where the sound generated inside a garment or an accessory must be reduced, such as in a pocket or in a backpack.

In the exemplary embodiment of FIG. 1, the material of the first layer 13 and the material of the second layer 14 are different materials. However, the material of the first layer 13 and the material of the second layer 14 may also be the same material. In this case, the material may have different properties in each layer. For example, the material in the first layer 13 may have a different density, fiber structure, shape, surface texture, etc. than the material in the second layer 14. Thus, in the first layer 13, the material may be more sound absorbing than in the second layer 14. On the other hand, the material in the second layer 14 may be more sound diffusing and/or reflecting than in the first layer 13.

In general, all layers according to the invention may be either made from one piece or may be made from different pieces which may be overlapping or not. For example, two or more pieces of a layer (e.g., the sound absorbing layer 13) could overlap over the ears of a wearer to increase sound absorbance. It is also possible that the thickness of a layer varies. For example, a sound absorbing layer 13 could be thicker in the area of the ears of a wearer to increase sound absorbance in that area.

In the exemplary embodiment of FIG. 1, the first layer 13 and the second layer 14 coincide in their entirety as they are arranged as layers of the hood 12. In other embodiments the first layer 13 may be separated from the second layer 14, i.e., both layers may be arranged at different locations on the garment 11. In further embodiments, the first layer 13 may at least partially overlap the second layer 14. Thus, different arrangements of the first layer 13 and the second layer 14 are possible which may be chosen depending on the type of application.

In the exemplary embodiment of FIG. 1, the sound insulation structure further comprises a third layer 15 comprising a sound diffusing material. The material of the third layer 15 is understood to be more sound diffusing than the material of the first layer 13 and the material of the second layer 14. In the exemplary embodiment of FIG. 1 different materials were chosen for the first layer 13 and the third layer 15. However, in other embodiments, the same material could be used for the first layer 13 and the third layer 15 having different properties in each layer. For example, the material in the first layer 13 may have a different density, fiber structure, shape, surface texture, etc. than the material in the third layer 15. Thus, in the first layer 13, the material may be more sound absorbing than in the third layer 15. On the other hand, the material in the third layer 15 may be more sound diffusing than in the first layer 13. The third layer 15 may for example be a warp knitted layer. Furthermore, the material of the third layer 15 may be a coating on the first layer 13, a coating on the second layer 14, or a coating on a further layer of the garment 11.

In the exemplary embodiment of FIG. 1, the sound diffusing inner layer 15 avoids or at least reduces the funnel effect described above by diffusing the impacting sound waves in all directions instead of focusing them onto the ears. Likewise, resonances may be reduced by the sound diffusing inner surface 15 of the hood 12.

Measurements conducted on an exemplary embodiment similar to that of FIG. 1 have been led. In this embodiment, the hood comprises a first layer made of a PU foam with open cells, an inner layer made of a mesh with open holes, and an outer layer made of a mesh with open holes. The three layers were stitched together on the edges of the hood. The sound insulation structure forms the hood and has a total thickness of about 3 mm.

For such measurements a mannequin head with a microphone placed on one of its ears has been placed in a room. In this room two speakers have been spaced apart by one meter and placed so as to form an equilateral triangle with the head of the mannequin. The measurements have been repeated with the mannequin looking between the two speakers (in a direction 30 degrees from each speaker, "front" in the table below), with the mannequin looking right from the speakers (in a direction 60 degrees from a first speaker and 120 degrees from the other, "right" in the table below), and with the mannequin looking away from the speakers (in a direction 150 degrees from each speaker, "rear" in the table below). A first series of measurements have been made with nothing on the mannequin's head, and a second series with said hood placed on the mannequin head.

The results of these measurements are provided in tables 1 and 2 below.

TABLE 1

| | Sound Magnitude Reduction | | | | | |
|---|---|---|---|---|---|---|
| | Front | | Right | | Rear | |
| | 1-4 kHz | 4-8 kHz | 1-4 kHz | 4-8 kHz | 1-4 kHz | 4-8 kHz |
| Average Reduction [dB/20 μPa] | 5.0 | 8.3 | 5.5 | 13.3 | 5.0 | 7.7 |
| Standard Deviation [dB/20 μPa] | 3.4 | 3.1 | 4.0 | 5.1 | 2.8 | 2.6 |
| Maximum reduction [dB/20 μPa] | 11.3 | 16.4 | 12.1 | 22.9 | 10.1 | 14.3 |

Table 1 shows the average reduction in sound wave magnitude on the indicated frequency range, the standard deviation around this average for the set of measurements obtained, and the maximum value in each frequency range, for each incoming direction of the sound (front, right, back). The magnitude reduction is measured in decibels, with the reference sound pressure being 20 μPa.

TABLE 2

| | Sound Loudness Reduction | | | | | |
|---|---|---|---|---|---|---|
| | Front | | Right | | Rear | |
| | 1-4 kHz | 4-8 kHz | 1-4 kHz | 4-8 kHz | 1-4 kHz | 4-8 kHz |
| Average Reduction [sone] | 0.36 | 0.72 | 0.57 | 0.97 | 0.38 | 0.71 |

TABLE 2-continued

| | Sound Loudness Reduction | | | | | |
|---|---|---|---|---|---|---|
| | Front | | Right | | Rear | |
| | 1-4 kHz | 4-8 kHz | 1-4 kHz | 4-8 kHz | 1-4 kHz | 4-8 kHz |
| Standard Deviation [sone] | 0.29 | 0.15 | 0.48 | 0.50 | 0.21 | 0.08 |
| Maximum reduction [sone] | 0.86 | 0.98 | 0.80 | 1.62 | 0.73 | 0.79 |

Table 2 shows the results of table 1 weighted by a human sensitivity to frequencies, the result being expressed in sones.

It should be noted that these measurements reflect the properties of an exemplary embodiment of the present invention and are not to be understood as limiting.

For example, the material of the first layer 13 and the material of the second layer 14 may be chosen so as to reduce average sound pressure by at least 6 dB, at least in the frequency range of 4,000 Hz to 20,000 Hz.

In general, in the context of the present invention, the sound insulation structure 10 for a garment 11 may reduce average sound pressure by at least 6 dB, at least in the frequency range of 4,000 Hz to 20,000 Hz. The sound insulation structure 10 may reduce average sound pressure by at least 8 dB, more particularly by at least 10 dB, and in some embodiments by at least 16 dB at least in the frequency range of 4,000 Hz to 20,000 Hz. The sound insulation structure 10 may reduce average sound pressure by at least 6 dB, in particular by at least 10 dB, and in some embodiments by at least 15 dB in the human ear range of 20 Hz to 20,000 Hz. The sound insulation structure 10 may reduce the sound perceived by a wearer of the garment 11 by at least one sone, more particularly by at least two sones. The sound insulation structure 10 may reduce average sound pressure and/or sound perceived by a wearer of the garment 11 for sound waves impacting the sound insulation structure 10 perpendicular to a surface of the sound insulation structure 10.

In general, in the context of the present invention, the sound insulation structure 10 for a garment 11 may have a total thickness of less than 30 mm. The total thickness may be less than 20 mm, in particular less than 10 mm, and in some embodiments less than 5 mm, e.g., about 3 mm. This is in particular true for a sound insulation structure with damping characteristics according to tables 1 and 2 above.

Furthermore, the sound insulation structure 10 for a garment 11 may reduce average sound pressure by at least 6 dB, at least in the frequency range of 4,000 Hz to 20,000 Hz and may comprise a total thickness of less than 30 mm, in particular less than 20 mm, in particular less than 10 mm, and in some embodiments less than 5 mm, e.g., about 3 mm. The sound insulation structure 10 comprising a total thickness of less than 30 mm, in particular less than 20 mm, in particular less than 10 mm, and in some embodiments less than 5 mm, e.g., about 3 mm, may reduce average sound pressure by at least 8 dB, more particularly by at least 10 dB and in some embodiments by at least 16 dB, at least in the frequency range of 4,000 Hz to 20,000 Hz. The sound insulation structure 10 comprising a total thickness of less than 30 mm, in particular less than 20 mm, in particular less than 10 mm, and in some embodiments less than 5 mm, e.g., about 3 mm, may reduce average sound pressure by at least 6 dB, in particular by at least 10 dB, and in some embodiments by at least 15 dB in the human ear range of 20 Hz to 20,000 Hz. The sound insulation structure 10 comprising a total thickness of less than 30 mm, in particular less than 20 mm, in particular less than 10 mm, and in some embodiments less than 5 mm, e.g., about 3 mm, may reduce the sound perceived by a wearer of the garment 11 by at least one sone, more particularly by at least two sones. The sound insulation structure 10 comprising a total thickness of less than 30 mm, in particular less than 20 mm, in particular less than 10 mm, and in some embodiments less than 5 mm, e.g., about 3 mm, may reduce average sound pressure and/or sound perceived by a wearer of the garment 11 for sound waves impacting the sound insulation structure 10 perpendicular to a surface of the sound insulation structure 10.

In the exemplary embodiment of FIG. 1, the first layer 13, the second layer 14, and the third layer 15 are permanently attached to each other and form, together, the sound insulation structure 10 which coincides with the garment's hood. The layers are stitched together at the edges of the hood by a merrow (or overlock) stitch. In general, however, different stitches or different joining techniques such as gluing or welding could be used as well.

However, in other embodiments, the first layer 13 or the second layer 14 or both may be removable from the sound insulation structure. The same is true for the third layer 15. Thus, at least one layer may be removably attached to the sound insulation structure 10. In one embodiment, the whole sound insulation structure 10 may be removably attached to the garment 11. Means for removably attaching the layers and/or the sound insulation structure may be a hook-and-loop fastener, a zipper, a press-stud, or the like.

In some embodiments, the first layer 13 and/or the second layer 14 and/or the third layer 15 (if present) may comprise perforations. In this way, breathability of the sound insulation structure and, thus, of the garment may be improved. Such perforations may, for example, be created by loops of a weft or warp knit fabric, by the apertures of a mesh, or may be punched out.

In the exemplary embodiment of FIG. 1, the hood 12 may be configured so that the distance between the hood 12 and an ear of a wearer is at maximum 20 cm. In some embodiments, the distance is less than 80 mm and more particularly between 10 mm and 40 mm. In some embodiments including, for example, the hooded garment 11 of FIG. 1, but also hats, beanies, headbands, and caps, the garment 11 may be fit on the ear of the wearer, thereby reducing the distance to 0 mm. The garment 11 may be stretchable so that the garment 11 tightly fits the wearer's head. At least a layer of said garment may be stretchable to tightly fit the wearer's head.

The hood 12 may be configured so that the frontal tip of the hood comes to the forehead of the wearer. The hood 12 may further be configured so that the frontal tip of the hood comes to the forehead of a wearer when the head of the wearer touches the back of the hood 12. In other embodiments, the hood comes down to the eyebrows. In further embodiments, the hood's tip may come down lower than the eyebrows (e.g., to the nose) in order to further reduce the incoming noise.

The hood 12 may be configured to enclose at least 220° of the space around a wearer's head, in particular at least 260°, and more particularly at least 275°. The covering angle of the hood 12 may be defined from the center of the wearer's head and may be defined in a cross sectional plane perpendicular to the wearer's longitudinal axis (i.e., a transverse plane in an anatomical meaning or horizontal plane).

The hood 12 may comprise means to tighten the opening of the hood. This permits lowering the sound entering from the front opening of the hood. The tightening means may be a draw cord. The cord may be arranged in a tunnel, e.g., sewn on the edge of the hood's opening.

The hood 12 may comprise a flap configured to be removably attached to the other side of an opening of the hood 12 so as to reduce the diameter of the opening of the hood 12. The flap may be attached to the hood 12 by means of a hook-and-loop fastener, a press-stud, a magnet, or the like. The flap may be arranged in the bottom of the hood 12 so as to close the opening in front of the neck of a wearer. In some embodiments, the flap may be configured to close the opening in front of a chin of a wearer.

Figure 2:
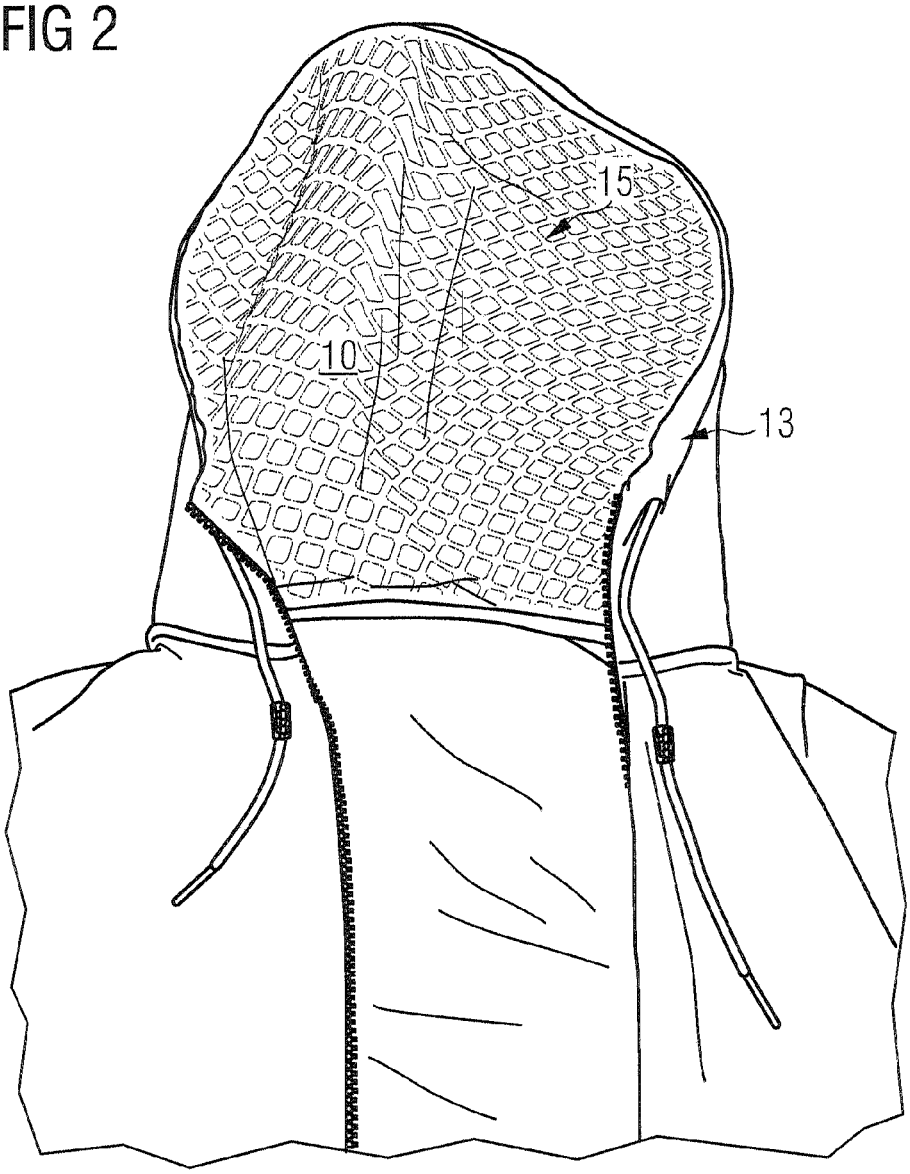
FIG. 2 shows a further exemplary embodiment of a sound insulation structure according to the invention arranged on a hooded garment.

FIG. 2 shows a further embodiment of a sound insulation structure 10 arranged on a hood 12 of a garment 11. In the exemplary embodiment of FIG. 2, the sound insulation structure 10 comprises a first layer 13 being the core layer of the hood 12, i.e., the first layer 13 defines the shape of the hood 12. The core layer is made from a sound absorbing material. The sound absorbing material is a PU foam with open cells.

Figure 6:
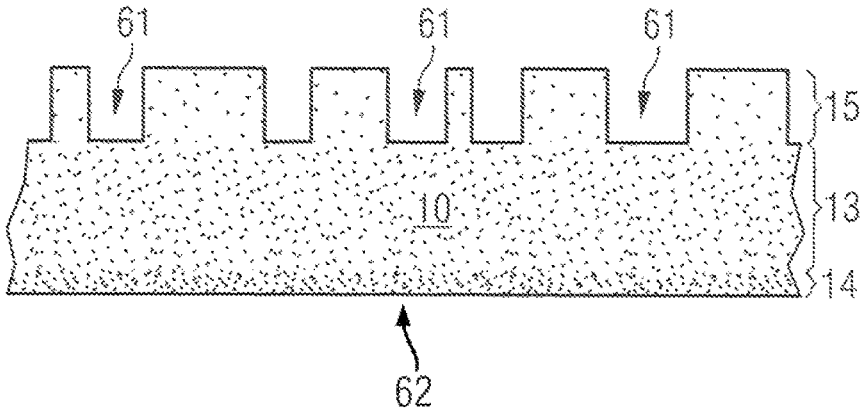
FIG. 6 shows a cross-sectional schematic illustration of a sound insulation structure according to the invention.
Figure 7:
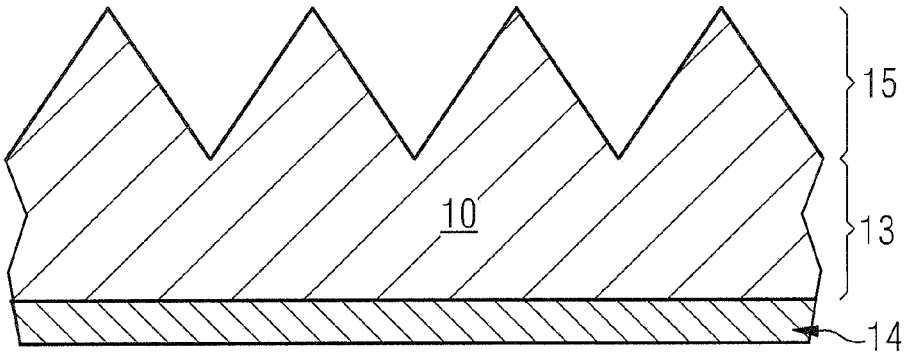
FIG. 7 shows a cross-sectional schematic illustration of a further exemplary arrangement of a first, second, and third layer according to the invention.

As in FIGS. 6 and 7, the sound absorbing material forms the core layer which is sound absorbing and an inner layer (i.e., the side of the hood 12 facing the head of the wearer) which is sound diffusing and sound absorbing. The inner layer 15 is sound absorbing because it is made of the same sound absorbing material as the core layer 13, and it is sound diffusing because it comprises a textured surface, for example a pyramid-shaped surface structure as in FIG. 7. Such a pyramid-shaped surface structure helps to diffuse incoming sound waves. The inner layer 15 is joined to the core layer 13 by stitching both layers at their respective edges. However, the layers may be joined at other locations additionally or alternatively. Furthermore, other techniques like welding or gluing could be used as well.

In this embodiment, the core layer 13 and inner layer 15 may be manufactured by a hot or cold forming process. To this end, foamed material is placed in a mold comprising a surface structure corresponding to the negative of the surface structure of the inner layer 15. Then, the material of the core layer 13 and inner layer 15 is pressed under pressure. The resulting material layers are cut to shape and an outer layer of the hood 12 may be joined to it by sewing, gluing, or welding, or be sprayed on it. An additional inner layer may be added onto the inner layer 15 to improve its sound diffusing properties and/or to improve the comfort of the wearer. In one embodiment, this inner layer may be acoustically transparent.

Figure 3:
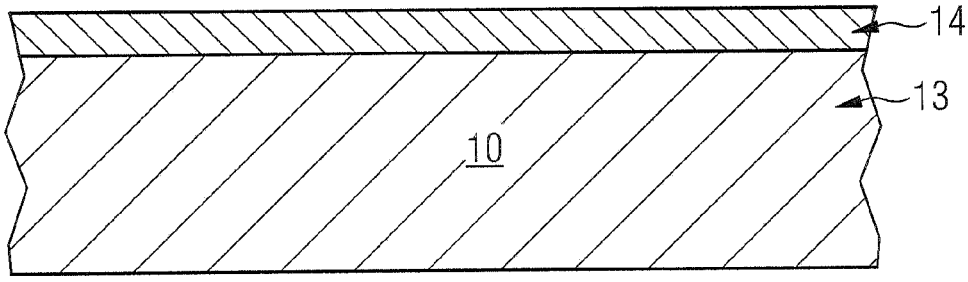
FIG. 3 shows an exemplary arrangement of a first and a second layer according to the invention in a cross-sectional schematic illustration.

FIG. 3 shows an exemplary arrangement of a first layer 13 and a second layer 14 according to the invention. The first layer 13 in this example is sound absorbing, whereas the second layer 14 is either sound diffusing, sound reflecting, or both. The second layer 14 in this example is bonded to the first layer 13, for example, by gluing. The second layer 14 may be arranged on an outer surface of the first layer 13 to reflect or diffuse ambient noise. In an alternative embodiment, the second layer 14 may be arranged on an inner surface of the first layer 13 to help reduce the sound generated inside a garment or bag. For example, the garment may comprise a pocket formed by a sound absorbing core layer 13 and lined on its inner surface by a sound reflecting or diffusing layer 14. Thus, sound generated by objects carried in the pocket (e.g., coins) is significantly reduced by such an arrangement. Consequently, such an arrangement could be used with a bag, like a backpack, sports bag, etc., as well.

Figure 4:
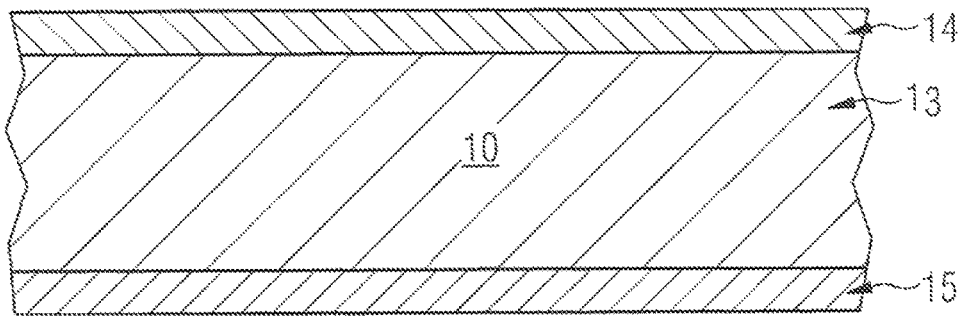
FIG. 4 shows an exemplary arrangement of a first, second, and third layer according to the invention in a cross-sectional schematic illustration.

FIG. 4 shows a further exemplary arrangement of a sound absorbing first layer 13, a sound reflecting second layer 14, and a sound diffusing third layer 15. The second layer 14 and the third layer 15 in this example are bonded to the first layer 13, for example, by gluing. The second layer 14 could be arranged on an outer surface of a garment and the third layer 15 could be arranged on an inner surface of a garment. Such an arrangement could be advantageous, for example, with a hooded garment, where the sound insulation structure 10 formed by the three layers 13, 14, and 15 is arranged on the hood or forms at least a part of the hood. In this example, the second layer 14 would reflect ambient noise, whereas the third layer 15 would diffuse ambient noise entering the hood through its opening, thus decreasing the funnel effect described above. It should be noted, however, that in other embodiments the arrangement of the second layer 14 and third layer 15 could be reversed, i.e., the second layer 14 could be arranged on an inner surface of the first layer 13 and the third layer 15 could be arranged on an outer surface of the first layer 13.

Figure 5:
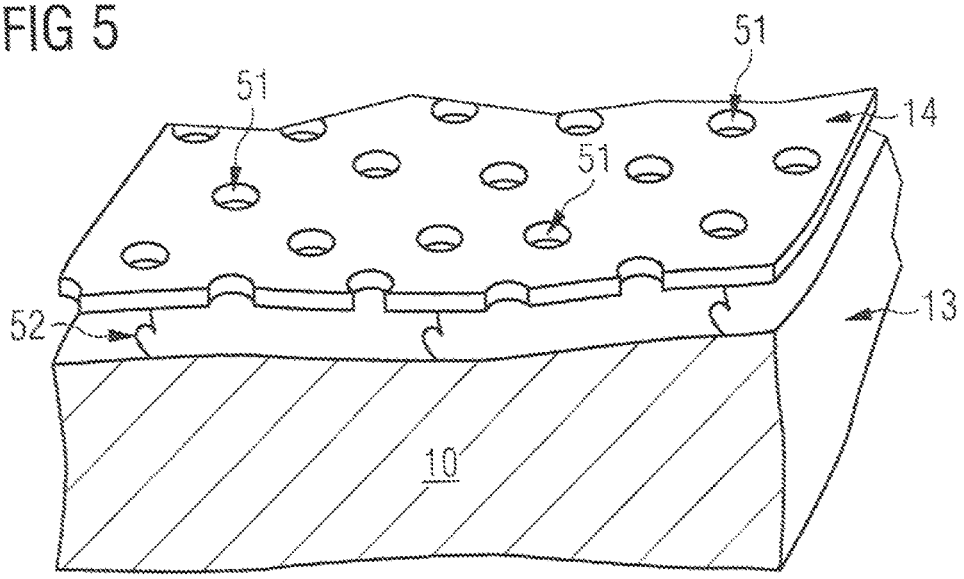
FIG. 5 shows a further exemplary arrangement of a first and a second layer according to the invention.

FIG. 5 shows a further exemplary embodiment of a sound absorbing first layer 13 and a second layer 14 according to the invention. In this example, the second layer 14 is sound diffusing. Additionally, the second layer 14 comprises holes, three of which are exemplarily denoted with the reference numeral 51. The second layer 14 may be a mesh, for example a knit polyester mesh The first layer 13 and second layer 14 are arranged, such that there is a gap between both layers. This is achieved by a yarn 52 which interconnects both layers 13 and 14. However, the yarn 52 does not join both layers 13 and 14, such that they would abut, like with a stitch. Instead, the yarn 52 allows for a spaced apart arrangement of both layers 13 and 14. This joining of the first layer 13 and second layer 14 may provide, in particular, a better comfort for the wearer.

FIG. 6 shows a cross sectional view of a further exemplary embodiment of a sound insulation structure 10 according to the invention. In this example, the sound insulation structure is made from a single material. The material comprises a density gradient in a direction perpendicular to a surface of the sound insulation structure 10. The material has a higher density on its outer surface 62 than in other portions, thereby creating a sound reflecting layer 14. Thus, the sound reflecting layer 14 is formed by high density material. Such density may be reached by different manufacturing processes, such as use of gravity during manufacturing to separate two layers, or curing (e.g., by heat), etc.

From this sound reflecting layer 14 the density decreases and a continuous layer of material forms the sound absorbing layer 13.

A sound diffusing layer 15 is created on the inner face of the sound insulation structure 10 by a surface texturing of the material. In the example of FIG. 6, this surface structure is formed by a random sequence of grooves, three of which are exemplarily denoted by the reference numeral 61. Other surface texturing could be used as well, such as pyramids, hemispheres, cubes, etc. which could be regular or random. In addition to facilitating sound diffusion, surface texturing also increases the flexibility and pliability of the sound insulation structure 10. The surface texturing can be formed during manufacturing the sound insulation structure 10, e.g., during molding, or could be formed in a later step, e.g., by cutting, milling, melting, etc.

FIG. 7 shows a further exemplary arrangement of the first layer 13, second layer 14, and third layer 15. In this example, the sound reflecting second layer 14 is bonded to the first sound absorbing layer 13, e.g., by gluing. The sound diffusing third layer 15 is made from the same material as the first sound absorbing layer 13 and formed in this material as a textured area. The texture in this example is pyramid-shaped. In general, other geometries like random or regular hemispheres, cones, cubes, ridges, etc. could be used as well.

Figure 8:
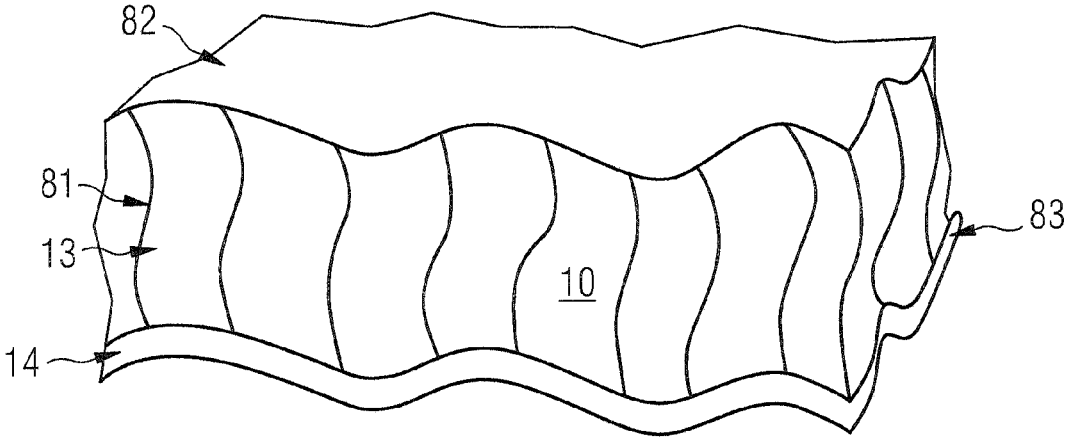
FIG. 8 shows a schematic illustration of a sound insulation structure according to the invention using a spacer knit.

FIG. 8 shows a further exemplary arrangement of a first layer 13 and a second layer 14 according to the invention. In this example the first sound absorbing layer 13 is realized as a spacer knit. A spacer knit is manufactured by weft-knitting or warp-knitting at least one spacer yarn 81 between two weft-knitted or warp-knitted plies 82 and 83, interconnecting the two plies 82 and 83 while leaving a gap between these two plies, and simultaneously serving as a filler. The spacer yarn 81 can comprise the same material as the plies 82 and 83 themselves, e.g., polyester, or another material. The spacer yarn 81 can also be a monofilament which provides the spacer weft-knitted fabric or spacer warp-knitted fabric with more stability. In the exemplary embodiment of FIG. 8 the second layer 14 is coated on a ply 83 of the spacer knit. Such a coating may, for example, be provided by spray coating. The gap between the two plies 82 and 83 of the spacer knit allows for additional frequency-selective noise cancellation, because the gap acts like a resonant filter for sound waves entering the spacer knit. Thus, the frequency response of the sound absorbing layer 13 can be set by varying the distance of the two plies 82 and 83 correspondingly.

Figure 9:
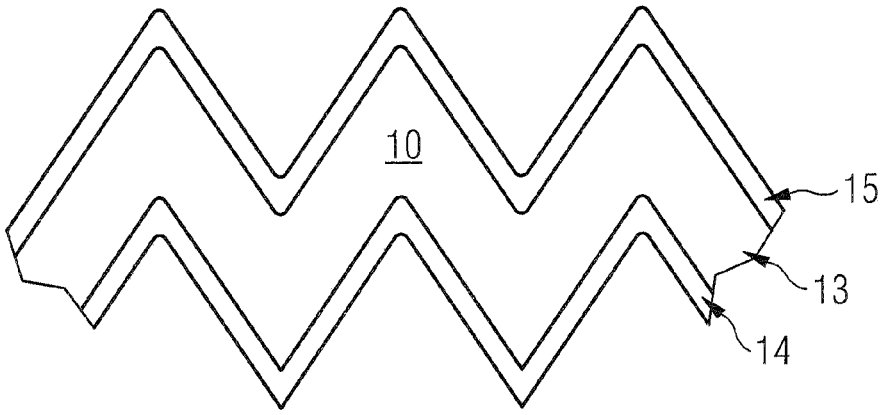
FIG. 9 shows a cross-sectional schematic illustration of an exemplary three-dimensional arrangement of a first, second, and third layer according to the invention.

FIG. 9 shows a further exemplary arrangement of the first layer 13, second layer 14, and third layer 15. In this example, all three layers comprise a 3D shape in the form of a zig-zag shape. In general, different shapes could be used as well, such as a sinusoidal or rectangular shape. Such a 3D shape further increases sound diffusion on both faces of the sound insulation structure 10, but also increases flexibility and pliability of the whole sound insulation structure 10.

Figure 10:
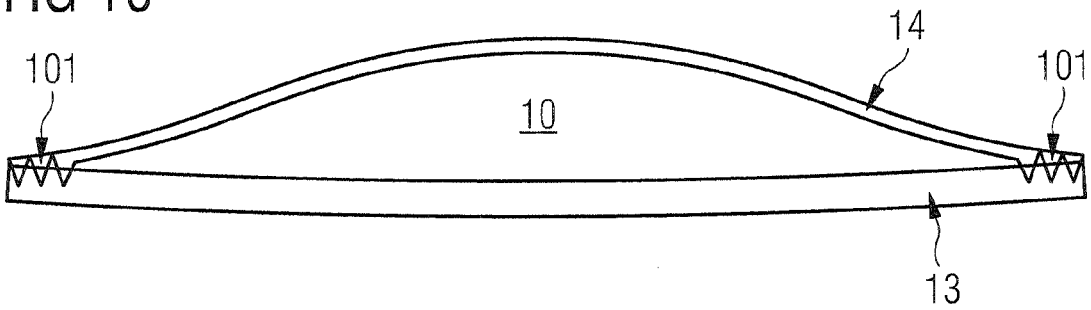
FIG. 10 shows a cross-sectional schematic illustration of a further exemplary arrangement of a first and a second layer according to the invention being joined at the periphery.

FIG. 10 shows a further exemplary arrangement of the first sound absorbing layer 13 and the second sound reflecting or diffusing layer 14. In this example, the first layer 13 and the second layer 14 are only joined along their periphery. Thus, in other locations the first layer 13 and the second layer 14 are allowed to be spaced apart. The gap between the first layer 13 and the second layer 14 could be filled for example by down, foam, or another filler material to increase thermal insulation. In the example of FIG. 10, both layers are joined by a seam 101 which can be sewn either by hand or by a sewing machine. In general, however, other techniques like welding or gluing could be used as well.

Figure 11:
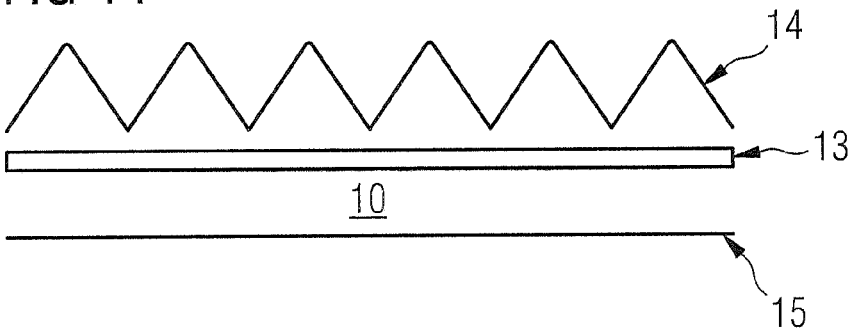
FIG. 11 shows a cross-sectional schematic illustration of a further exemplary arrangement of a first, second, and third layer according to the invention, wherein the second layer is textured.

FIG. 11 shows a further exemplary embodiment of a sound insulation structure 10 according to the invention, wherein the second layer 14 is shaped with plies, but not the first layer 13. In the example, the second layer 14 comprises a triangular or pyramid shape and is spaced apart from the first layer 13. The shape of the second layer 14 can be obtained by folding the second layer 14 appropriately. Other shapes could be used as well, such as hemispheres, cones, cubes, ridges, etc. In this example, the shaped second layer 14 could be an inner layer or an outer layer of a garment.

In some embodiments, at least one layer may be obtained by a melt-blown process. In a melt-blown process, molten filaments emerge from a spinneret, are drawn by a primary air flow, and are broken into staple fibers by eddy currents. A secondary air flow transfers the fibers onto a substrate. Melt blowing is a very efficient process for producing non-woven fabrics. The layer may be obtained by blowing fibers onto a substrate.

More particularly, the first sound-absorbing layer may be obtained by a melt-blown process. In particular, the size and density of the fibers may be chosen to obtain a high sound absorption in a targeted range of frequencies.

The second layer may be obtained by a post-processing of one face of the non-woven first layer, for example by application of heat and/or pressure. The second layer may also be obtained by applying heat and/or pressure to a non-woven fabric, which is then combined with the first layer.

The substrate may be a three-dimensional shape. Thereby, the non-woven layer may be directly formed in a three-dimensional shape of the final product. Thus, no additional forming of the non-woven fabric is required as it is directly made to its useful shape. The three-dimensional shape may, for example, be a shape of a head, a hood, a pocket, etc.

The substrate may have a texture. The non-woven layer thereby adopts a negative texture on its face in contact with the substrate. Such texture may enhance comfort and/or sound diffusion.

The substrate may comprise a plurality of holes in at least a portion of its surface and the method may further comprise the step of applying a pressure differential to the plurality of holes, so that the fibers transferred onto the substrate are attracted by the pressure differential. This allows compacting the fibers together to obtain a more dense non-woven fabric. In some embodiments, it may also allow creating a texture on the surface so as to improve its sound diffusion, sound absorption, and/or comfort, in particular with a wide array in which the fibers are pulled in the holes of the array so as to form padded humps on the surface of the non-woven fabric.

The present invention has been described above by way of exemplary embodiments. Accordingly, the present invention should not be limited by any of the above-described exemplary embodiments, but should be defined only in accordance with the following claims and their equivalences. Further, when a particular feature, structure, or characteristic is described in connection with an embodiment, it is submitted that it is within the knowledge of one skilled in the art to effect such feature, structure, or characteristic in connection with other embodiments whether or not explicitly described.

What is claimed is:

1. A sound insulation structure for a garment, the sound insulation structure comprising:

a first layer comprising a sound absorbing material; and a second layer attached to the first layer, the second layer configured to be at least one of sound reflecting and sound diffusing, wherein at least one of the first layer and the second layer comprises a mesh, and wherein the sound insulation structure forms at least a part of the garment.

2. The sound insulation structure of claim 1, wherein the first layer and the second layer at least partially overlap.

3. The sound insulation structure of claim 1, wherein the second layer forms an outer surface of the garment.

4. The sound insulation structure of claim 1, further comprising a third layer configured to be sound diffusing, wherein the second layer is configured to be sound reflecting.

5. The sound insulation structure of claim 4, wherein the third layer forms an inner surface of the garment.

6. The sound insulation structure of claim 1, wherein the first layer and the second layer are configured to reduce average sound loudness by 0.5 to 1 sone in the frequency range of 4,000 Hz to 8,000 Hz in portions where the first layer and the second layer overlap.

7. The sound insulation structure of claim 1, wherein the sound insulation structure has a total thickness of less than 30 mm.

8. The sound insulation structure of claim 1, wherein the first layer is textured on at least one surface.

9. The sound insulation structure of claim 1, wherein the second layer is a coating.

10. The sound insulation structure of claim 1, wherein at least one of the first layer and the second layer are removable from the sound insulation structure.

11. The sound insulation structure of claim 1, wherein at least a portion of the sound insulation structure is configured to be part of a hood.

12. The sound insulation structure of claim 11, wherein the hood comprises a frontal tip, and wherein the frontal tip is configured to be disposed at a wearer's forehead.

13. The sound insulation structure of claim 11, wherein the hood is configured to enclose at least 220° of space around a wearer's head in a horizontal plane at a center of the wearer's head.

14. The sound insulation structure of claim 11, wherein the hood comprises a draw cord configured to tighten an opening of the hood.

15. The sound insulation structure of claim 11, wherein the hood comprises a flap removably attached to a side of an opening of the hood, and wherein the flap is configured to reduce an opening of the hood.

16. A garment comprising the sound insulation structure of claim 1.

17. The garment of claim 16, wherein the garment comprises a hood, and wherein the sound insulation structure is disposed at the hood.

18. The garment of claim 16, wherein the garment comprises a hat, a beanie, or a headband.

19. The garment of claim 16, wherein the sound insulation structure is removably attached to the garment.

20. A sound insulation structure for a wearable accessory, the sound insulation structure comprising:

a first layer comprising a sound absorbing material; and a second layer attached to the first layer, the second layer configured to be at least one of sound reflecting and sound diffusing, wherein at least one of the first layer and the second layer are removable from the sound insulation structure, and wherein the sound insulation structure forms at least a part of the wearable accessory.

21. A method of manufacturing a sound insulation structure for a garment, the method comprising:

providing a first layer comprising a sound absorbing material;

providing a second layer configured to be at least one of sound reflecting and sound diffusing;

molding the second layer such that the second layer is configured to diffuse sound;

joining the first layer and the second layer; and forming at least a part of the garment with the first layer and the second layer.

22. The method of claim 21, further comprising:

arranging the first layer and the second layer such that the first layer and the second layer at least partially overlap in the garment.

23. The method of claim 21, further comprising:

providing a third layer configured to be sound diffusing; and joining the third layer and the first layer, wherein the second layer is configured to be sound reflecting.

24. The method of claim 21, further comprising:

molding the sound absorbing material such that the sound absorbing material diffuses sound on at least one surface.

25. The method of claim 20, wherein at least one of the first layer and the second layer comprises a mesh.

26. The method of claim 21, wherein at least one of the first layer and the second layer comprises a mesh.

* * * * *